US007259725B2

(12) United States Patent
Wang et al.

(10) Patent No.: US 7,259,725 B2
(45) Date of Patent: Aug. 21, 2007

(54) LOG-PERIODIC DIPOLE ARRAY ANTENNA

(75) Inventors: Wei-Jen Wang, Miao-Li County (TW); Jo-Wang Fu, Miao-Li County (TW)

(73) Assignee: Coretronic Corporation, Miao-Li County (TW)

( * ) Notice: Subject to any disclaimer, the term of this patent is extended or adjusted under 35 U.S.C. 154(b) by 0 days.

(21) Appl. No.: 11/454,729

(22) Filed: Jun. 16, 2006

(65) Prior Publication Data

US 2007/0018901 A1 Jan. 25, 2007

(30) Foreign Application Priority Data

Jul. 19, 2005 (TW) ..... 94124258 A

(51) Int. Cl.
*H01Q 11/10* (2006.01)

(52) U.S. Cl. ..... 343/792.5; 343/821

(58) Field of Classification Search ..... 343/792.5, 343/793, 795, 821
See application file for complete search history.

(56) References Cited

U.S. PATENT DOCUMENTS 5,212,494 A * 5/1993 Hofer et al. ..... 343/859
6,734,827 B2 * 5/2004 Killen et al. ..... 343/792.5
6,952,189 B2 * 10/2005 Engargiola et al. ..... 343/792.5

* cited by examiner

*Primary Examiner*—Tan Ho
(74) *Attorney, Agent, or Firm*—J.C. Patents

(57) ABSTRACT

A log-periodic dipole array antenna including a dielectric substrate, and antenna elements, symmetrical microstrip lines and baluns disposed on two corresponding surfaces of the substrate is provided. The antenna elements on each surface are connected to one side of the corresponding symmetrical microstrip line, respectively. The width of at least one antenna element on each surface is broadened gradually outwards from the side of the antenna element, which is connected to the corresponding symmetrical microstrip line. In addition, the baluns are connected to the ends of the corresponding symmetrical microstrip lines, respectively. The antenna elements on one surface are in a mirror-image relation to those on the other surfaces. The log-periodic dipole array antenna features increased broadband with a thin and compact-size, better margin in design to meet different bandwidth requirements.

15 Claims, 2 Drawing Sheets

LOG-PERIODIC DIPOLE ARRAY ANTENNA

CROSS-REFERENCE TO RELATED APPLICATION

This application claims the priority benefit of Taiwan application serial no. 94124258, filed on Jul. 19, 2005. All disclosure of the Taiwan application is incorporated herein by reference.

BACKGROUND OF THE INVENTION

1. Field of Invention

The present invention relates to an antenna, more particularly, a log-periodic dipole array antenna.

2. Description of Related Art

Recently, the wireless communication device has become lighter, thin, and smaller along with the evolution of integrate circuit technology. The planar antenna made by printed circuit method with advantages such as: a high level of integration and a being integrated with peripheral devices easily. The planar antenna made by printed circuit method has gradually been the main stream in current communication industry. However, the bandwidth and the radiation efficiency of the conventional antenna are unavoidably decreased after the conventional antenna being minimized, and the transmission and the receiving of signals are relatively limited, and the communication quality furthermore affected. Therefore, the super-broadband has become the desired objective for a good antenna. In addition, how to increase the broadband or to provide a structure more suitable for miniaturization of the antenna has been a primary issue for the antenna design.

SUMMARY OF THE INVENTION

Accordingly, the present invention is directed to provide a log-periodic dipole array antenna featuring increased broadband with a thin and compact-size, better margin to meet different bandwidth requirements.

According to the above or other objectives, the present invention provides a log-periodic dipole array antenna, including a dielectric substrate, a first symmetrical microstrip line, a plurality of first antenna elements, a first balun, a second symmetrical microstrip line, a plurality of second antenna elements and a second balun. The dielectric substrate has a first surface and a corresponding second surface, wherein the first symmetrical microstrip line, the first antenna elements and the first balun are disposed on the first surface, and the second symmetrical microstrip line, the second antenna elements and the second balun are disposed on the second surface. The first antenna elements are connected to one side of the first symmetrical microstrip line, wherein the width of the first antenna element is broadened gradually outwards from the side of said antenna element, which is connected to the first symmetrical microstrip line, and the first balun is connected to one end of the first symmetrical microstrip line. The second antenna elements are connected to one side of the second symmetrical microstrip line, wherein the positions of the first antenna element and the second antenna element on the dielectric substrate are in a mirror-image relation, and the width of the second antenna element is broadened gradually outwards from the side of the second antenna element connected to the second symmetrical microstrip line, and the second balun is connected to one end of the second symmetrical microstrip lines.

Accordingly, for wider bandwidth, the present invention provides the log-periodic dipole array antenna by starting with the shape design of the antenna elements; therefore, the width of the antenna element is broadened gradually outwards from the side of the antenna element, which is connected to the corresponding symmetrical microstrip line. That is, the present invention can provide a better margin by changing the shape of the antenna elements for adjustment of broadband operations, and make the size of a log-periodic dipole array antenna with a lighter, thin and compact size.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
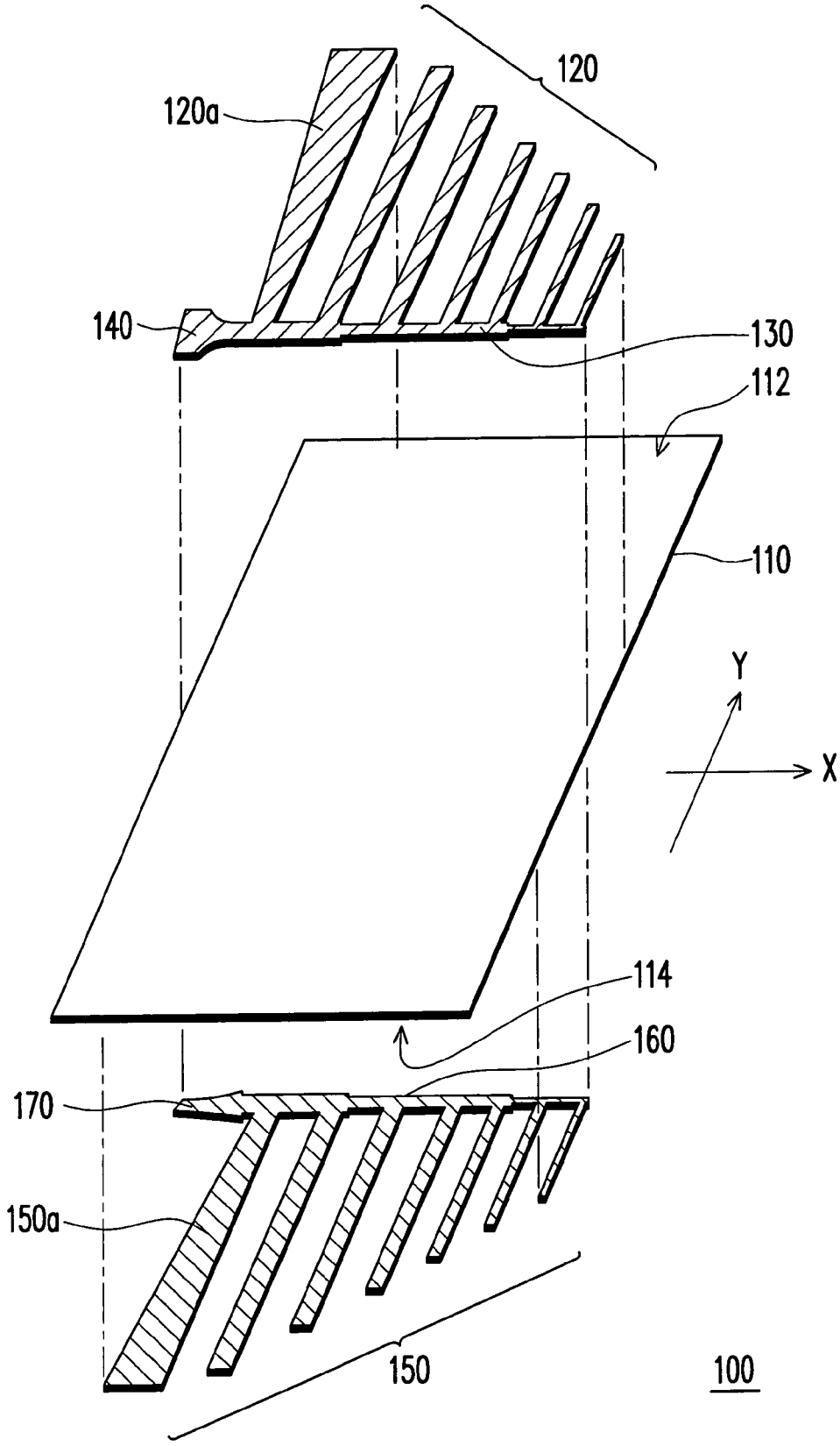
FIG. 1 is a schematic disassembly view of a log-periodic dipole array antenna according to one embodiment of the present invention.

Please refer to FIG. 1, a schematic disassembly view of a log-periodic dipole array antenna according to one embodiment of the present invention. As shown in FIG. 1, the log-periodic dipole array antenna 100 includes a dielectric substrate 110, a plurality of antenna elements 120, a first symmetrical microstrip line 130, a first balun 140, a plurality of second antenna elements 150, a second symmetrical microstrip line 160, and a second balun 170. The dielectric substrate 110 has a first surface 112 and a second surface 114. The dielectric substrate 110 can be a hard substrate or other dielectric substrates commonly used in general printed circuit board, such as: a dielectric substrate composed of fiberglass or epoxy resin. The dielectric substrate 110 is used as a supporting substrate for antenna patterns, wherein the antenna patterns disposed on the first surface 112 and the second surface 114 are electrically separated by the dielectric substrate 110.

The first antenna element 120, the first symmetrical microstrip line 130 and the first balun 140 are disposed on the first surface 112 of the dielectric substrate 110, and, the second antenna element 150, the second symmetrical microstrip line 160 and the second balun 170 are disposed on the second surface 114 of the dielectric substrate 110 wherein the first antenna element 120, the first symmetrical microstrip line 130 and the first balun 140, for examples, are formed by patterning a conductive layer (not shown in drawings) disposed on the first surface 112 of the dielectric substrate 110. Additionally, the second antenna element 150, the second symmetrical microstrip line 160 and the second balun 170 can also be formed on the second surface 114 of the dielectric substrate 110 in the same way. In other words, the conductive layer can be made with a copper foil or other suitable material commonly used in general printed circuit board.

The first antenna element 120 is connected to one side of the first symmetrical mircostrip line 130, wherein the width of a first antenna element 120*a* is broadened gradually outwards from one side of the first antenna element 120*a* connected to the first symmetrical microstrip line 130. Take the first antenna element 120*a* for example. The first symmetrical mirostrip line 130 extends upward along the X direction while the width of the first antenna element 120*a* is broadened gradually from one side of the first antenna element 120*a* connected to the first symmetrical microstrip line 130 along Y direction. In the present invention, the width of the shape of the first antenna element 120*a* is broadened gradually, the operating bandwidth of the log-periodic dipole array antenna 100 is broadened and the length of the first antenna element 120*a* decreases accordingly. Moreover, the first antenna element 120*a* can be in polygon or other regular or irregular shapes as long as the element corresponding to features of the gradually increasing width outwards from one side of the first antenna element 120*a* connected to the symmetrical microstrip line 130. Take the first antenna element 120*a* for example. The first antenna element 120*a* of the embodiment is a quadrilateral shape.

The second antenna element 150 is connected to one side of the second symmetrical mircostrip line 160, wherein the width of a second antenna element 150*a* is broadened gradually outwards from one side connected to the second symmetrical microstrip line 160. Take the microstrip line 160 for example. The second symmetrical mirostrip line 160 extends upward along the X direction while the width of the second antenna element 150*a* is broadened gradually from one side connected to the second symmetrical microstrip line 160 along Y direction. In the present invention, the width of the shape of the second antenna element 150*a* is broadened gradually, the operating bandwidth of the log-periodic dipole array antenna 100 is broadened and the length of the second antenna element 150*a* decreases accordingly. Moreover, the second antenna element 150*a* can be in polygon or other regular or irregular shapes as long as the second antenna element 150*a* corresponding to features of gradually increasing width outwards from one side of the second antenna element 150*a* connected to the symmetrical microstrip line 160. Take the second antenna element 150*a* for example. The second antenna element 150*a* of the embodiment is in a quadrilateral shape.

The first and second symmetrical microstrip lines 130 and 160 are correspondingly disposed at equivalent corresponding positions of the dielectric substrate 110; and the first and second baluns 140 and 170 are also correspondingly disposed at equivalent corresponding positions of the dielectric substrate 110, and the first and second baluns 140 and 170 are connected to one end of the first and second symmetrical microstrip lines 130 and 160, respectively. In the present invention, the width of the first balun 140 is broadened gradually outwards from one side of the first balun 140 connected to the first symmetrical microstrip line 130 and a negative pole (grounding) of an antenna feeding port. Moreover, the width of the second balun 170 is broadened gradually outwards from one side of the second balun 170 connected to the second symmetrical microstrip line 160 and a positive pole of the antenna feeding port.

Referred to FIG. 1 again, the locations of the first antenna element 120 and the second antenna element 150 on the dielectric substrate 110 are in a mirror-image relation. It is noted that the first antenna elements 120 paralleling to each other are arranged on the same side of the first symmetrical microstripe line 130, and the length of these first antenna elements 120 along the long axis deceases gradually along the direction away from the first balun 140 (X direction). Moreover, the second antenna elements 150, paralleling to each other, are arranged on the side of the second symmetrical microstripe line 160 corresponding to the first antenna element 120, and the lengths of the second antenna elements 150 along the long axis decease gradually along the direction away from the second balun 170 (X direction).

Figure 2:
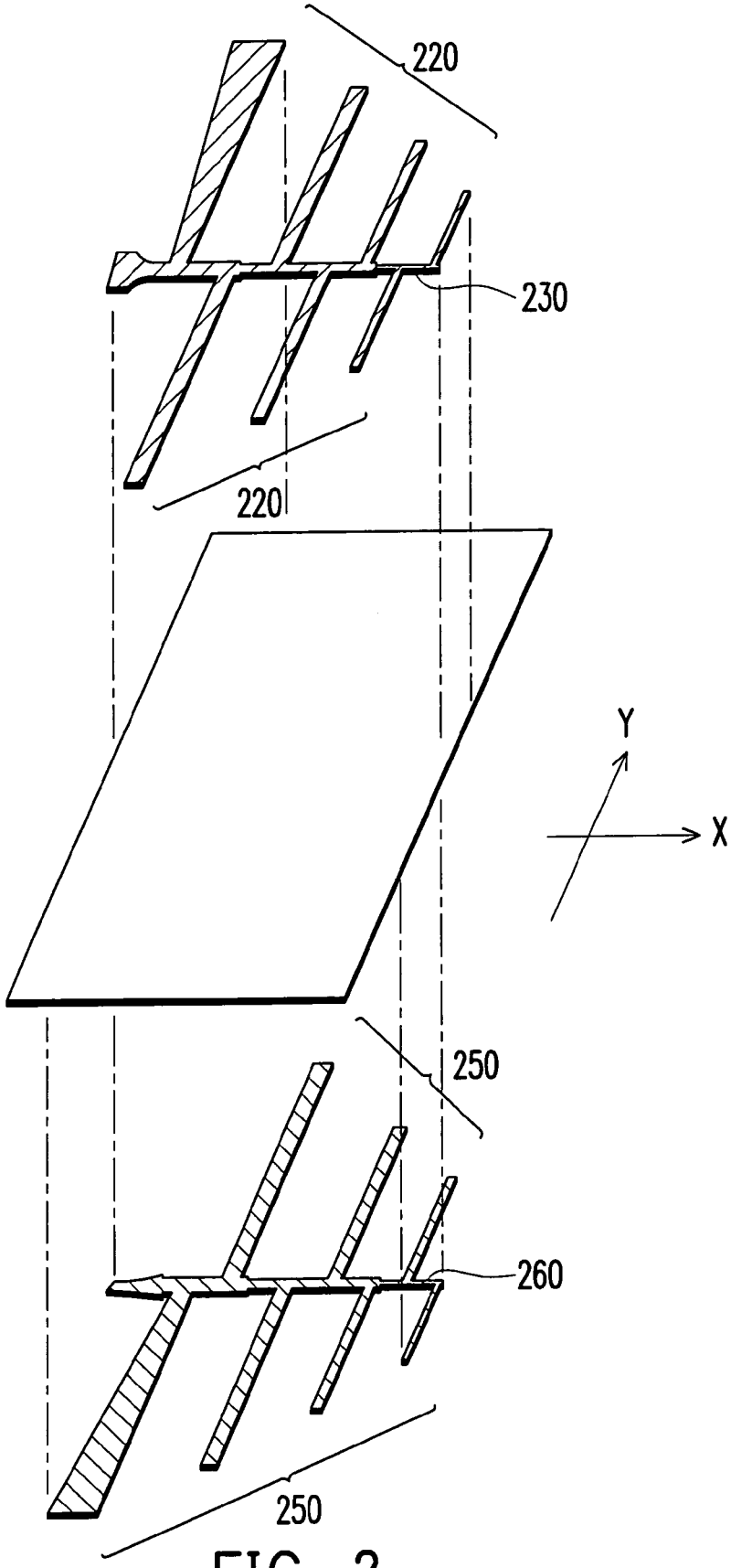
FIG. 2 is a schematic disassembly view of a log-periodic dipole array antenna according to another embodiment of the present invention.

Essentially, the antenna element of the present invention is not limited to be disposed on the same side of the corresponding symmetrical microstrip line, and the location of the antenna elements can be adjusted according to actual design requirements. FIG. 2 is a schematic disassembly view of a log-periodic dipole array antenna according to another embodiment of the present invention, wherein the first antenna element 220, for example, is disposed interlacedly with each other on the first symmetrical microstrip line 230, and the second antenna element 250, for example, is disposed interlacedly with each other on the two corresponding sides of the second symmetrical microstrip line 260.

It is noted that, although at each side in the log-periodic dipole array antenna of the present invention, only one antenna element is provided with width variation, the present invention is not limited to such features. Specifically speaking, the log-periodic dipole array antenna of the present invention can have more than two antenna elements with width variation at each side, wherein the operation bandwidth of the antenna can be adjusted by changing the numbers, locations and shapes of the antenna elements. Accordingly, the present invention can provide better margin for the structure of the log-periodic dipole array antenna with decreased numbers and lengths of the antenna elements, and thin and compact size of the log-periodic dipole array antenna.

In summary, the log-periodic dipole array antenna of the present invention at least has the following advantages:

Firstly, the antenna element has a gradually increasing width outwards from one side connected to the symmetrical microstrip line; therefore, the objective of a wider operating bandwidth can be achieved.

Secondly, the width variation of the antenna element can increase the operation bandwidth, so that the number and length of the antenna elements are decreased. Such features are helpful for miniaturization of the log-periodic dipole array antenna.

Thirdly, the operating bandwidth can be adjusted by changing the numbers, locations and shapes of the antenna elements; therefore, the present invention provides larger margin in design.

Lastly, the shapes and the design theories of the symmetrical microstrip line and the balun are so simple that the difficulty in designs and revisions for different products is remarkably reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A log-periodic dipole array antenna, including:

a dielectric substrate, having a first surface and a corresponding second surface;

a first symmetrical microstrip line, disposed on the first surface;

a plurality of antenna elements, disposed on the first surface and connected to at least one side of the first symmetrical microstrip line, wherein at least one of the first antenna elements has a gradually increasing width outwards from the side of the antenna element, which is connected to the first symmetrical microstrip line;

a first balun, disposed on the first surface and connected to one end of the first symmetrical microstrip lines;

a second symmetrical microstrip line, disposed on the second surface;

a plurality of second antenna elements, disposed on the second surface and connected to at least one side of the second symmetrical microstrip line, wherein the positions of the first antenna elements and the second antenna elements on the dielectric substrate are in a mirror-image relation, and the width of at least one of the second antenna elements is broadened gradually outwards from the side of the antenna element, which is connected to the second symmetrical microstrip line; and a second balun, disposed on the second surface and connected to one end of the second symmetrical microstrip lines.

2. The log-periodic dipole array antenna as claimed in claim 1, wherein the first balun and the second balun are disposed at equivalent corresponding positions of the dielectric substrate.

3. The log-periodic dipole array antenna as claimed in claim 1, wherein the first symmetrical microstrip line and the second symmetrical microstrip line are disposed at equivalent corresponding positions of the dielectric substrate.

4. The log-periodic dipole array antenna as claimed in claim 1, wherein the first antenna elements are arranged in approximately parallel to each other.

5. The log-periodic dipole array antenna as claimed in claim 1, wherein the lengths of the first antenna elements along a long axis decrease gradually along a direction away from the first balun.

6. The log-periodic dipole array antenna as claimed in claim 1, wherein the first antenna elements are arranged on the same side of the first symmetrical microstrip line.

7. The log-periodic dipole array antenna as claimed in claim 1, wherein the first antenna elements are arranged on the two corresponding sides of the first symmetrical microstrip line.

8. The log-periodic dipole array antenna as claimed in claim 1, wherein the first antenna element is in polygon shape.

9. The log-periodic dipole array antenna as claimed in claim 8, wherein the first antenna element is in quadrilateral shape.

10. The log-periodic dipole array antenna as claimed in claim 1, wherein the second antenna elements are arranged in approximately parallel to each other.

11. The log-periodic dipole array antenna as claimed in claim 1, wherein the lengths of the second antenna elements along a long axis decrease gradually along a direction away from the second balun.

12. The log-periodic dipole array antenna as claimed in claim 1, wherein the second antenna elements are arranged on the same side of the second symmetrical microstrip line.

13. The log-periodic dipole array antenna as claimed in claim 1, wherein the second antenna elements are arranged on the two corresponding sides of the second symmetrical microstrip line.

14. The log-periodic dipole array antenna as claimed in claim 1, wherein the second antenna element is in polygon shape.

15. The log-periodic dipole array antenna as claimed in claim 14, wherein the second antenna element is in quadrilateral shape.

* * * * *